United States Patent [19]

Kwitkowski et al.

[11] Patent Number: 4,703,289

[45] Date of Patent: Oct. 27, 1987

[54] DISTRIBUTED RESONATOR STRIPLINE CIRCULATOR AND METHOD FOR FABRICATING SAME

[75] Inventors: Peter A. Kwitkowski, Elgin; Peter Nanni, Hoffman Estates; Carl Missele, Elgin; Norman E. O'Shea, Lake in the Hills; Anthony M. Pirih, Roselle, all of Ill.

[73] Assignee: Motorola, Inc., Schaumburg, Ill.

[21] Appl. No.: 809,984

[22] Filed: Dec. 17, 1985

[51] Int. Cl.[4] ..... H01P 1/387; H01P 11/00

[52] U.S. Cl. ..... 333/1.1; 29/600; 29/830; 333/238

[58] Field of Search ..... 333/1.1, 238; 29/600, 29/825, 829, 830

[56] References Cited

U.S. PATENT DOCUMENTS

| | | | |
|---|---|---|---|
| 2,926,317 | 2/1960 | Blitz | 333/238 |
| 3,467,918 | 9/1969 | Dunn et al. | 333/1.1 |
| 3,753,156 | 8/1973 | Miura et al. | 333/1.1 |
| 3,758,878 | 9/1973 | Wainwright | 333/1.1 |
| 3,935,548 | 1/1976 | Rosenbaum et al. | 333/1.1 |
| 4,110,712 | 8/1978 | Morris | 333/238 X |
| 4,122,418 | 10/1978 | Nagao . | |
| 4,609,892 | 9/1986 | Higgins, Jr. | 333/204 |

OTHER PUBLICATIONS

Helszain, *Nonreciprocal Microwave Functions and Circulators*, John Wiley & Sons, N.Y., 1975, Title page and pp. 212 & 321 relied on TK7871.65 H44.

Bosma, "On Stripline Y-Circulation at UHF", I.E.E.E. Transactions on Microwave Theory and Techniques, pp. 61–72, Jan., 1964.

*Primary Examiner*—Paul Gensler

*Attorney, Agent, or Firm*—Thomas G. Berry

[57] ABSTRACT

A distributed resonator stripline circulator is disclosed wherein a geometrically shaped resonator pattern is deposited upon a like geometrically shaped ferrite substrate. A ground plane is deposited upon the opposing side of the substrate which includes grounding wrap-arounds that extend partially onto the resonator face of the substrate. Two such resonators are assembled, resonator patterns facing, to form a stripline circulator. The grounding wrap-arounds provide electrical connection from the top ground plane to the bottom ground plane to provide superior isolation and control of circulator loading factors.

10 Claims, 6 Drawing Figures

-PRIOR ART-

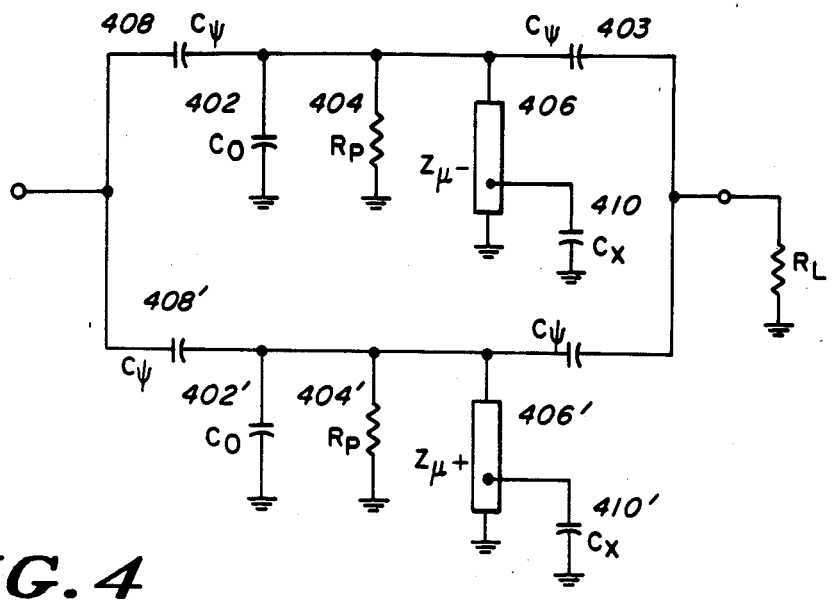
FIG. 4
FIG. 3
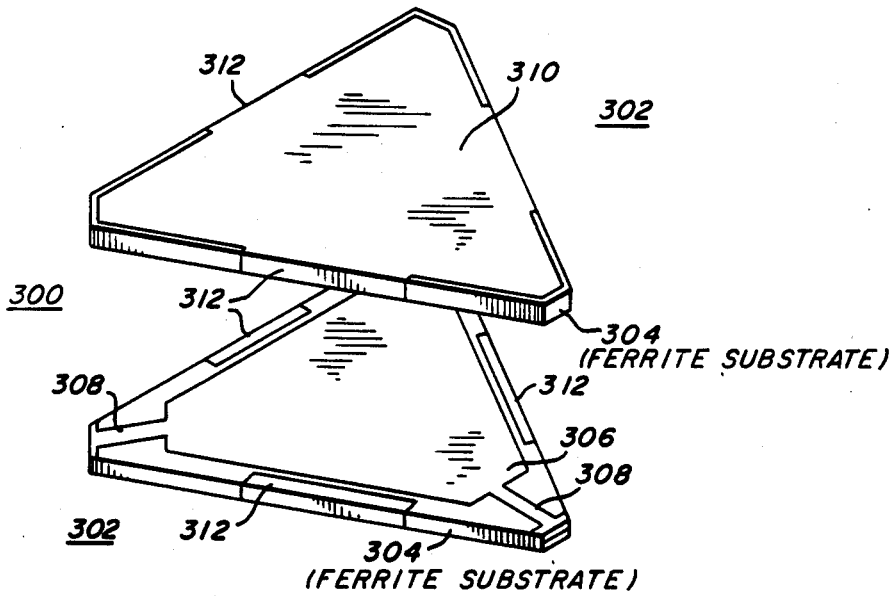

DISTRIBUTED RESONATOR STRIPLINE CIRCULATOR AND METHOD FOR FABRICATING SAME

BACKGROUND OF THE INVENTION

This invention relates generally to circulator devices and more particularly to an improved stripline circulator.

Those skilled in the art will appreciate that circulators are used extensively in radio communication equipment. One well known use of a circulator is to combine a transmitter and receiver to a single antenna. Another use for circulators is to isolate reflected power from a transmitter radio frequency power amplifier. Typically, high power radio frequency amplifiers must operate at a high level of electrical efficiency and be free from parasitic oscillation. In order to achieve these requirements under all load conditions, it is desirable to place a circulator at the output of the power amplifier. In a configuration such as this the forward power will pass through the circulator to the antenna, and reflected power, due to any impedance mismatch, will be terminated into a load.

Prior circulators were typically constructed from discrete mechanical parts. The circulator was assembled by stacking and aligning the ground plane, ferrite substrates and a resonator. Adhesives were commonly applied during the assembly process to maintain proper alignment of the individual parts. Due to the various mechanical and assembly tolerances, prior circulator assembly techniques could not produce a consistent circulator structure, which lead to inconsistent circulator performance. Further, the use of adhesives generally resulted in a circulator with poor temperature performance.

Accordingly, a need exists to find a simple inexpensive circulator that is easy to manufacture and avoids the temperature and tolerance buildup problems of the prior art.

SUMMARY OF THE INVENTION

Accordingly, it is an object of the present invention to provide an improved circulator which overcomes the deficiencies of the prior art.

It is a further object of the present invention to provide a circulator with reliably consistent performance.

It is another object of the present invention to provide a circulator that is inexpensive to manufacture.

It is the ultimate object of the present invention to provide an improved distributed resonator stripline circulator.

Briefly, the present invention contemplates a distributed resonator stripline circulator wherein a resonator pattern is deposited upon a geometrically shaped ferrite substrate. A ground plane is deposited upon the opposing side of the substrate which includes ground wrap-arounds that extend partially onto the resonator face of the substrate. Two such resonators are assembled, resonator patterns facing, to form a stripline circulator by applying solder paste to the resonator pattern and the grounding wrap-arounds, and reflowing the solder paste to make electrical connections. The grounding wrap-arounds provide electrical connection from the top ground plane to the bottom ground plane to provide superior isolation and control of loading factors.

BRIEF DESCRIPTION OF THE DRAWINGS

The features of the present invention which are believed to be novel are set forth with particularity in the appended claims. The invention, together with further objects and advantages thereof, may be understood by reference to the following description taken in conjunction with the accompanying drawings, and the several figures of which like reference numerals identify like elements, and in which:

FIG. 3 is an exploded view of the circulator in accordance with the present invention;

FIG. 4 is a schematic diagram of an equivalent electrical model of the present invention.

DETAILED DESCRIPTION OF THE PREFERRED EMBODIMENT

Figure 1:
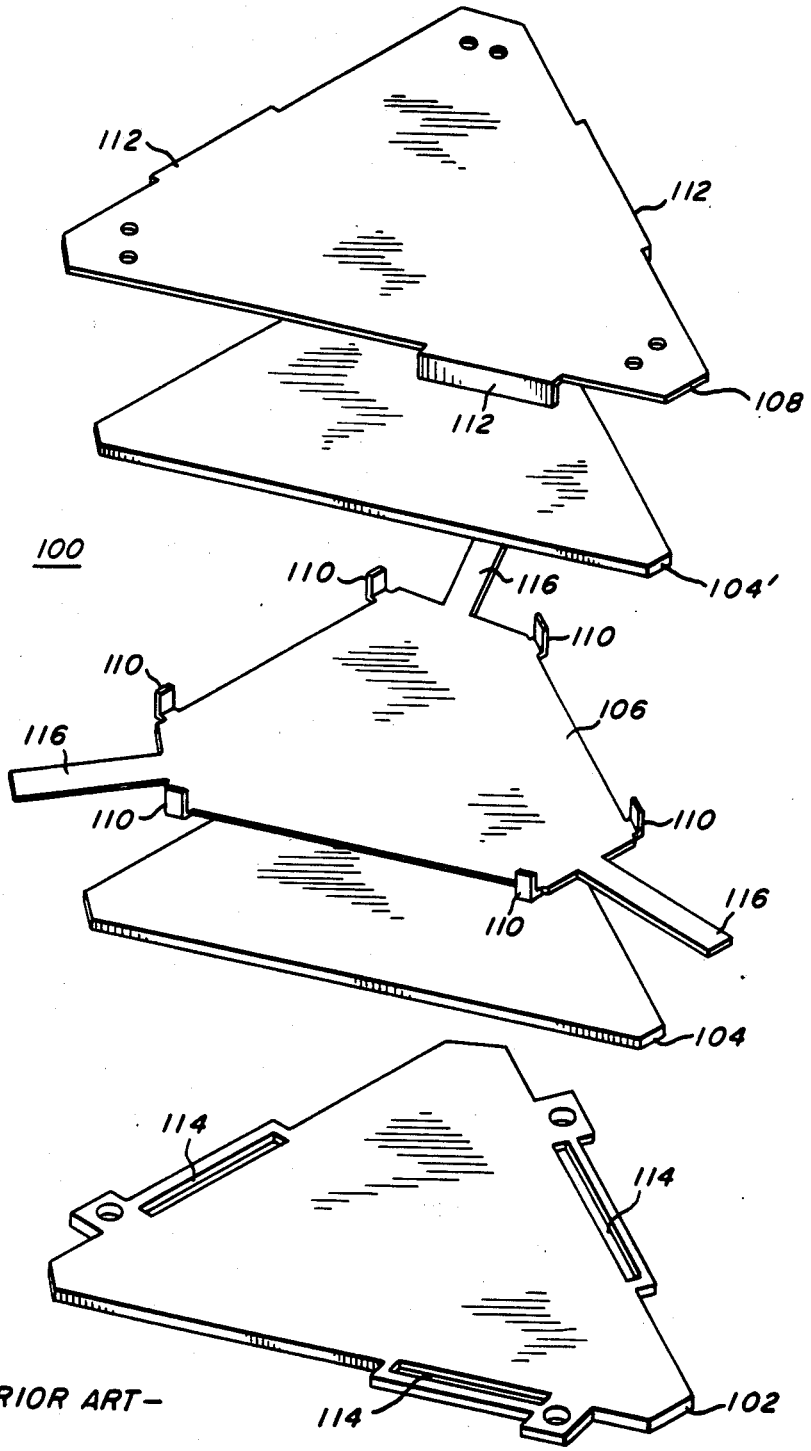
FIG. 1 is an exploded view of a circulator in accordance with the prior art.

Referring now to FIG. 1 there is shown a typical circulator 100 constructed in accordance with the prior art. Basically, the circulator 100 is comprised of a base plate 102 upon which is placed a ferrite substrate 104, which is typically a ferrite material and may be yttrium-iron-garnet (YIG) or other suitable ferrimagnetic material. A resonator 106 is positioned between the two YIG substrates 104 and 104', the upper most of which is positioned by tabs 110. A top cover 108 completes the assembly by aligning tabs 112 of the top cover plate 108 into the slots 114 of the base plate 102. Typically, adhesives may be used between the layers to aid in maintaining the alignment of the individual components. However, various mechanical tolerances in both alignment and individual component flatness result in a laborious assembly process resulting in a circulator with unreliable, or, in a mass production environment, circulators having widely varying performance parameters.

Many factors influence the performance of a circulator. The magnetic bias, the type of ferrite material used, resonator geometry and loading factors are important parameters in the design procedure. Design equations are known for conventional circulators which predict performance and allow for the optimization of a circulator design.

In a conventional circulator, the loading factor is determined by the width of the feedlines 116 which couple radio frequency (RF) energy into and out of the resonator 106. A typical design parameter associated with the loading is called the "half angle" and is denoted $\psi$. Those skilled in the art will appreciate that loading may be optimized analytically by imposing the required conditions for the circulation on the parameters dependent on $\psi$. However, due to the addition of the ground wrap-arounds (312 in FIG. 3), the typical design equations known for the prior art do not provide a sufficiently accurate model to properly design the circulator of the present invention. Accordingly, many of the standard design equations, particularly the loading factor, must be modified.

Figure 2A:
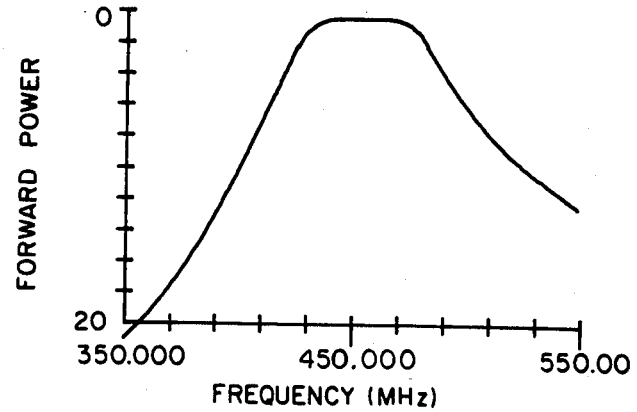
FIG. 2*a–c* are graphical illustrations of circulator loading.
Figure 2B:
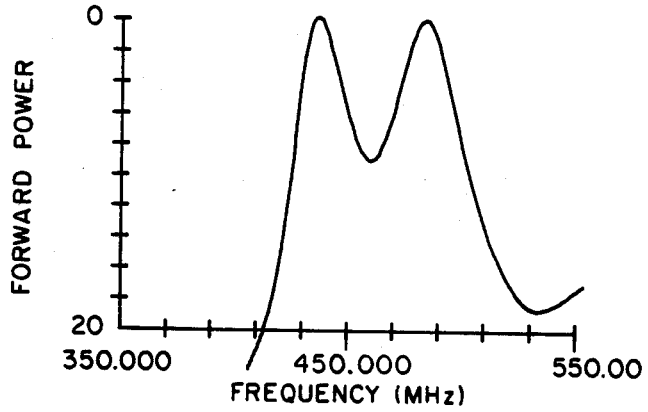
Figure 2C:
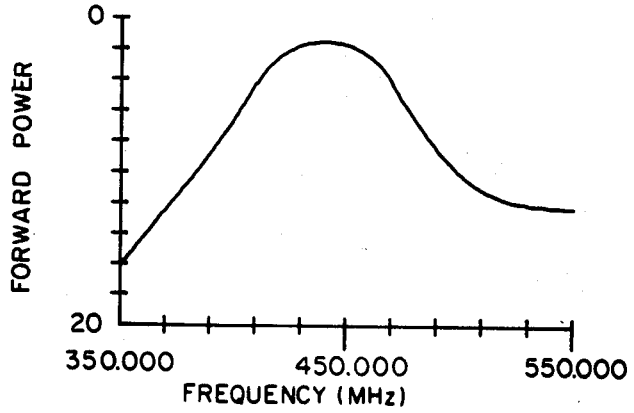

Referring now to FIGS. 2*a*–2*c*, the effect of loading on circulator performance is shown. FIG. 2*a*, a critically coupled circulator exhibits a smooth "bandpass" type response with optimal insertion loss and bandwidth. Decreasing loading from the critical value degrades circulator performance by separating the +/− counter-rotating resonances and introducing a notch into the passband as illustrated in FIG. 2*b*. FIG. 2*c* illustrates the case where the loading factor has been increased to be greater than the critical value, thereby reducing the bandwidth and degrading the insertion loss.

In the circulator of the present invention, loading comes from two sources. The conventional feed line loading experienced in the prior art is still present, however, additional loading due to the coupling between the resonator edges and the ground plane wrap-around metallization is also present.

Referring now to FIG. 3, there is shown an exploded view of the circulator 300 of the present invention. Basically, the circulator 300 is comprised of two identical resonators 302. Each resonator 302, is comprised of a substrate 304, which may be any suitable ferrite material and preferably is a YIG substrate. A resonator pattern 306 is deposited on the face of the substrate and feedlines 308 (two shown) are extended to the edge of the substrate 304. In the preferred embodiment, the resonator is deposited using well known thick film plating processes. Of course, any suitable depositing process may be used. On the opposing face of the substrate, a ground plane 310 is deposited and portions thereof are extended around the edge of the substrate 304 onto the resonator face of the substrate. Thick film techniques are preferrably employed to deposit the ground plane 310. The ground wrap-arounds 312 may be extended using any suitable method such as edge painting or similar technique. These ground wrap-arounds 312 provide the benefit of having a superiorly coupled ground plane, however, add an additional loading term not experienced by circulators of the prior art. In fact, if the standard design equations were used, the resulting circulator would be an overcoupled device with sub-optimum performance. To correctly model the circulator of the present invention, the total loading L becomes:

$$L=L_{\psi}+L_{x} \tag{1}$$

Where $L_x$ denotes the wrap-around ground plane loading contribution and $L_{\psi}$ represents the feedline loading.

The placement of the wrap-arounds 312 is critical, both in their spacing from the resonator 306 and their location relative to the feedlines 308. As the wrap-arounds 312 are moved closer to the resonator 306 or the feedlines 30B, the electric field intensity around the resonator perimeter becomes greater and the loading effects of the wrap-around 312 will increase. Thus, placing the wrap-arounds 312 in the vicinity of the feedlines 308 increases the loading term $L_x$ due to the higher electric field intensity encountered in that area. Accordingly, it is advantageous to place the wrap-arounds 312 approximately equidistant from any of the feedlines 308. In the preferred embodiment of the present invention, the substrate 304, and thus the entire circulator 300 is triangularly shaped. Therefore, it is advantageous to centrally position the wrap-arounds 312 along each face of the triangular substrate 304 thereby providing an optimally grounded circulator with minimal additional loading due to the wrap-arounds 312.

Referring now to FIG. 4, there is shown a schematic diagram of an equivalent electrical model of the circulator of the present invention. The basic resonators are modelled as the parallel combination of a capacitor $C_o$ (402 and 402'), which represents the intrinsic parallel plate capacitance of the resonator; a resistor $R_p$ (404 and 404'), which represents the stripline resonator losses; and, an inductor, which is shown as a shorted transmission line, $Z_{\mu}$ (406 and 406'). Each resonator has coupling capacitors $C_{\psi}$ (408 and 408') that represents the loading of each resonator by the feedlines 308. The resonator model is completed by the addition of capacitors $C_x$ (410 and 410') which represents the effective capacitance resulting from the proximity of the resonator and the wrap-arounds 312. Those skilled in the art will appreciate that as $C_x$ is moved upward along $Z_{\mu}$, the effective loading attributable to $C_x$ is increased even if the value of $C_x$ is held constant. Similarly, placing the ground wrap-arounds 312 in the vicinity of the feedlines 308 increases the loading term $L_x$ (see equation 1), due to the higher electric field intensity encountered there.

Proper circulator characteristics require loading the two resonators such that the critically coupled bandpass response of FIG. 2*a* is obtained. Typical circulator design techniques adjust the loading by varying the feedline width, which adjusts the $C_{\psi}$ term in the model of FIG. 4. The present invention contemplates the additional loading term $C_x$, to more accurately define the operational performance of the circulator of the present invention. Thus, the present invention allows the design of a critically coupled circulator overcoming the detriments of prior art circulators.

Accordingly, the present invention provides an improved distributed resonator stripline circulator that is both simple and inexpensive to build, and has superior performance over the prior art, while still being capable of optimum loading.

While a particular embodiment of the invention has been described and shown, it should be understood that the invention is not limited thereto since many modifications may be made. It is therefore contemplated to cover by the present application any and all such modifications that may fall within the true spirit and scope of the basic underlying principles disclosed and claimed herein.

What is claimed is:

1. A distributed resonator stripline circulator device for operation in a magnetic field and having at least three input/output ports, comprising:

a first and second triangularly shaped ferrite substrate, each having a substantially planar top and bottom portion, said top portion being substantially covered by a ground plane deposited thereon and said bottom portion having a resonator pattern deposited thereon including at least three feedlines extending approximately to the edge of said substrate at said input/output ports, said circulator including means for controlling the loading factor thereof comprising ground plane extensions from said top portion to said bottom portion of each of said triangularly shaped substrates, said extensions being substantially centered along each side of each of said triangularly shaped substrates, said circulator being constructed by electrically coupling said first and second triangularly shaped ferrite substrates, resonator patterns facing, at said controlling means and said feelines.

2. The device of claim 1, wherein said resonator pattern and said ferrite substrate have a like geometric shape.

3. A method for controlling the loading factor of a distributed resonator stripline circulator, comprising the steps of:

(a) fabricating a first and second resonator, each fabrication comprising the steps of:

(1) depositing a resonator pattern upon a first surface of a geometrically shaped ferrite substrate;

(2) depositing a ground plane upon a second surface of said geometrically shaped ferrite substrate;

(3) extending said ground plate onto said first surface of said geometrically shaped ferrite substrate;

(b) intercoupling said first and second resonators such that said resonator patterns are in close spacial proximity, and said ground planes are electrically connected via said ground plate extensions, whereby said ground plane extensions are constructed and arranged to operably control the loading factor of the circulator.

4. The method of claim 3, wherein said depositing step comprises depositing an effective amount of a metallic compound upon said substrate using thick film processes.

5. The method of claim 3, wherein said extending step comprises edge painting an effective amount of a metallic compound upon said substrate.

6. The method of claim 3, wherein said geometric shape is substantially triangular.

7. The method of claim 6, wherein said extending step comprises edge painting an effective amount of a metallic compound in a substantially central position along each side of said triangularly shaped ferrite substrate.

8. The method of claim 3, wherein said intercoupling step comprises depositing an effective amount of solder paste upon said resonator pattern and said ground plane extended portions, and reflowing said solder paste to form electrical connections.

9. The method of claim 3, wherein said deposited resonator pattern and said ferrite substrate have a like geometric shape.

10. A method for controlling the loading factor of a distributed resonator stripline circulator, comprising the steps of:

(a) fabricating a first and second triangularly shaped resonator each fabrication comprising the steps of:

(1) depositing a triangularly shaped resonator pattern upon a first surface of a like shaped ferrite substrate such that at least three feedlines extend to the vertices of said ferrite substrate;

(2) depositing a ground plane substantially covering a second surface of said ferrite substrate;

(3) extending said ground plane onto said first surface by edge painting an effective amount of a metallic compound at substantially central positions along each side of said triangularly shaped ferrite substrate;

(b) intercoupling said first and second resonators by depositing an effective amount of solder paste upon said feedlines and said extended ground plane, and reflowing said solder paste to form electrical connections, whereby said ground plane extensions are constructed and arranged to operably control the loading factor of the circulator.

* * * * *

UNITED STATES PATENT AND TRADEMARK OFFICE

CERTIFICATE OF CORRECTION

PATENT NO. : 4,703,289

DATED : October 27, 1987

INVENTOR(S) : Kwitkowski, Peter; Nanni, Peter; Missele, Carl; O'Shea, Norman and Pirih, Anthony.

It is certified that error appears in the above-identified patent and that said Letters Patent is hereby corrected as shown below:

Column 5, line 19, "plate" should be --plane--.

Signed and Sealed this

Fifth Day of April, 1988

*Attest:*

*Attesting Officer*

DONALD J. QUIGG

*Commissioner of Patents and Trademarks*